US006536107B1

(12) United States Patent
Scholler et al.

(10) Patent No.: US 6,536,107 B1
(45) Date of Patent: Mar. 25, 2003

(54) METHOD FOR PRODUCING CONTACT JACKS FOR ELECTRIC PLUG-IN CONNECTORS

(75) Inventors: Johann Scholler, Deggendorf (DE); Rainer Schätzl, Hauzenberg (DE)

(73) Assignee: Interconnectron GmbH, Deggendorf (DE)

( * ) Notice: Subject to any disclaimer, the term of this patent is extended or adjusted under 35 U.S.C. 154(b) by 0 days.

(21) Appl. No.: 09/744,632

(22) PCT Filed: Jul. 13, 1999

(86) PCT No.: PCT/DE99/02183

§ 371 (c)(1),
(2), (4) Date: Jan. 26, 2001

(87) PCT Pub. No.: WO00/07266

PCT Pub. Date: Feb. 10, 2000

(30) Foreign Application Priority Data

Jul. 27, 1998 (DE) ..... 198 33 675

(51) Int. Cl.[7] ..... H01B 43/02

(52) U.S. Cl. ..... 29/877; 29/825; 29/874; 29/876; 29/884

(58) Field of Search ..... 29/825, 827, 874, 29/876, 877, 883, 884, 885, 846, 848, 412, 413, 414, 415, 566.1, 566.2, 566.3, 745–749, 755; 439/843, 851

(56) References Cited

U.S. PATENT DOCUMENTS 3,107,966 A * 10/1963 Bonhomme ..... 439/843
5,649,838 A * 7/1997 Sung ..... 439/578
5,653,615 A * 8/1997 Inaba et al. ..... 439/827
6,062,919 A * 5/2000 Trafton ..... 439/843
6,358,104 B2 * 3/2002 Daugherty et al. ..... 439/851

FOREIGN PATENT DOCUMENTS

FR 2610456 A1 * 8/1988
GB 2065993 A * 7/1981
JP 3291874 A * 12/1991

* cited by examiner

*Primary Examiner*—Jiping Lu
(74) *Attorney, Agent, or Firm*—Sidley Austin Brown & Wood, LLP

(57) ABSTRACT

A method for producing contact jacks for electric plug-in connectors. The method comprises the steps of providing a continuous strip of a sheet metal material, as a supporting material, with a curvature that is limited on both sides by flat longitudinal edge regions or a comparable deformation that is directed longitudinally centrally and transversely to its plane; punching out a contact strip sequence with contacting strips having a width exceeding the width of the supporting material, while leaving spacing-assuring edge strips; undetachably connecting the contacting strips along respective longitudinal edge regions with the supporting material using a contact-assuring method; cutting off a sheath surface of a jack from a continuous strip of the sheet metal material, equipped with the contacting means, at a length corresponding to that of a jack, and rolling the surface into a jack; and bringing the curvature or comparable deformation into a stretching position such that the finished jack has a smooth cylindrical outer surface.

6 Claims, 3 Drawing Sheets

METHOD FOR PRODUCING CONTACT JACKS FOR ELECTRIC PLUG-IN CONNECTORS

FIELD OF THE INVENTION

Figure 2:
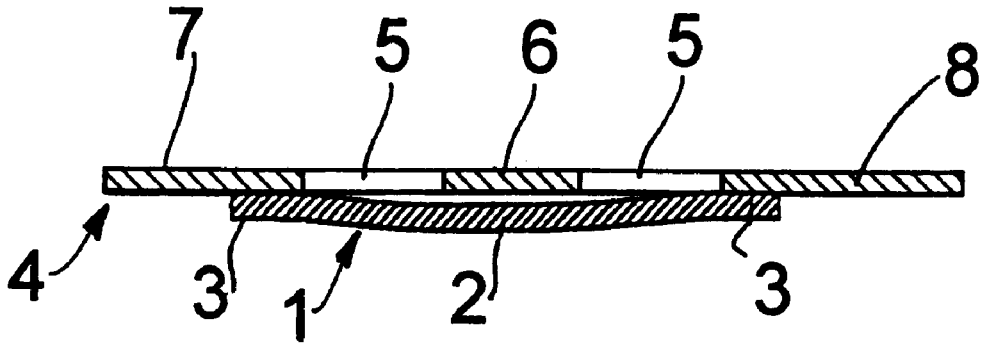

The invention relates to a method for producing contact jacks for electric plug-in connectors, which consist of at least one stable sleeve body and a plurality of contacting means, such as contacting wires or contacting strips to enter into a linear or strip-shaped contact, and for which the contacting wires or contacting strips are aligned twisted around the axis of the jack, the stable sleeve body consisting of a sheet metal material and the contacting means in each case being connected at both ends with the sheet metal material.

1. Background Information and Prior Part

Contact jacks, prepared by this method and frequently also referred to as wire spring or laminar spring contact jacks, are distinguished, on the one hand, by exceptionally outstanding contacting properties and, on the other, by the fact that they can be manufactured economically. For this method of manufacture, it is advantageous that the jacks can be produced independently of their other equipment, such as a component of semi-finished products, which can in each case be pre-manufactured as a strip material, and may be connected with them, simply by assembling, cutting to length, rolling up and optionally welding the borders together.

2. Objects of the Invention

It is therefore an object of the invention to develop a method for the cost-effective production of jacks, equipped with a plurality of contacting means, such as contacting wires or contacting strips, which are twisted around the axis of the jack or aligned at an angle to the axis of the jack, so that the production and the electrically conducting connection of the contacting means with the strip material, forming a stable bushing, is favored further.

SUMMARY OF THE INVENTION

Pursuant to the invention, this objective is accomplished essentially owing to the fact that a) a continuous strip of a sheet metal material, as supporting material, is provided with a curvature or a comparable deformation, directed longitudinally centrally and transversely to its plane; b) at the same time, a contact strip sequence is produced from a further strip material; c) the contacting means, contacting wires or contacting strips are connected undetachably to the sheet metal material, which has been provided with a curvature or a comparable deformation directed towards the longitudinal center and transversely to its plane, as supporting material forming the stable bushing; d) longitudinal sections, corresponding to the sheath surface of a jack are cut off from a continuous strip of a sheet metal material, equipped with the contacting means and rolled up into a jack; e) in the course of the rolling up of a section of the continuous strip of a sheet metal material, equipped with the contacting means, into a jack, the curvature or comparable deformation of which, directed longitudinally centrally at right angles to the plane is bought into a stretching position in such a manner, that the finished jack has a smooth cylindrical outer surface, provisions being made in particular so that the contacting means, contacting wires or contacting strips, while leaving a spacing-assuring edge strip, are punched out in a strip material having a width exceeding the width of the strip material used to produce the stable sleeve body and with which a strip material, forming a stable sleeve body and having a deformation directed transversely to its plane, is connected.

The punched out contacting means, contacting wires or contact strips, provided pursuant to the invention and extending over the whole width of the strip material forming the stable sleeve body, make rectangular or square cross sections possible even of punched-out material forming contacting means in the shape of a wire and, at the same time, also provide better possibilities for connecting the contacting means electrically conducting with the sleeve body. The special advantage that the jacks can be produced also independently of the other equipment of a component, possibly connected with them, from semi-finished products, which can be prefabricated as a strip material, simply by assembling, cutting to length and rolling up, as well as possibly welding together the borders, is retained.

In a first and preferred embodiment of the inventive method, using a contact-assuring joint-producing method, the contacting means, contacting wires or contact strips, bridging the curvature or deformation of which are connected individually and along the two longitudinal edge regions with strip material forming the stable sleeve body, and subsequently, preceding the rolling up of the jacks, the spacing-assuring edge strips are severed. By these means, to begin with, the cutout or stamping of the individual contacting means, especially of the wire-shaped contacting means, can be facilitated and, furthermore, the construction of the electrically conducting connection of the individual contacting means, contacting wires or contacting strips with the strip material, forming the stable sleeve body, can be improved. Appropriate joining methods for a fascinating the contacting means, contacting wires or contacting strips at both ends to the two edges of the strip material, forming the stable sleeve body, are, to begin with, welding methods such as pressure welding, laser welding or friction welding. However, all other methods for forming an electrically conducting contact, such as pressure methods for forming a joint, especially extrusion methods, are also suitable.

The inventive feature of leaving a spacing-assuring edge strip outside of the intended jack height or the width of the strip material, forming the stable sleeve body, thus also makes it possible in a very simple manner to maintain constant mutual distances between the contacting means, contacting wires or contacting strips, so that the connection of contacting means, contacting wires or contacting strips, punched out in the strip material at an angle to the longitudinal axis of the jack, corresponding to their intended alignment with respect to the axis of the jack, can be also be brought about without problems with the strip material forming the stable sleeve body.

The inventive feature of leaving a spacing-assuring edge strip outside of the intended jack height or the width of the strip material, forming the stable sleeve body at the same time, however, also makes available a modified procedure with respect to the fastening of the contacting means, contacting wires or contacting strips at the strip material, forming a stable sleeve body, especially in the sense that the contacting means, contacting wires or contacting strips, punched out leaving spacing-assuring edge strips in a strip material having a width exceeding the width of the strip material used to produce the stable sleeve body, are connected with the strip material, forming the stable sleeve body, by flanging the spacing-assuring edge strips around the longitudinal edges of the strip of material forming the stable sleeve body. The method of connecting by flanging also includes here a more or less pronounced pressing, especially in order to decrease the local material thickenings, formed for some application cases by the flanged edges, to such an extent, that they no longer interfere.

Furthermore, according to this modified embodiment of the inventive method, the flangings are carried out in the region between the two spacing-assuring edge strips of the strip material having the punched-out contacting means, contacting wires or contacting strips.

Figure 1:
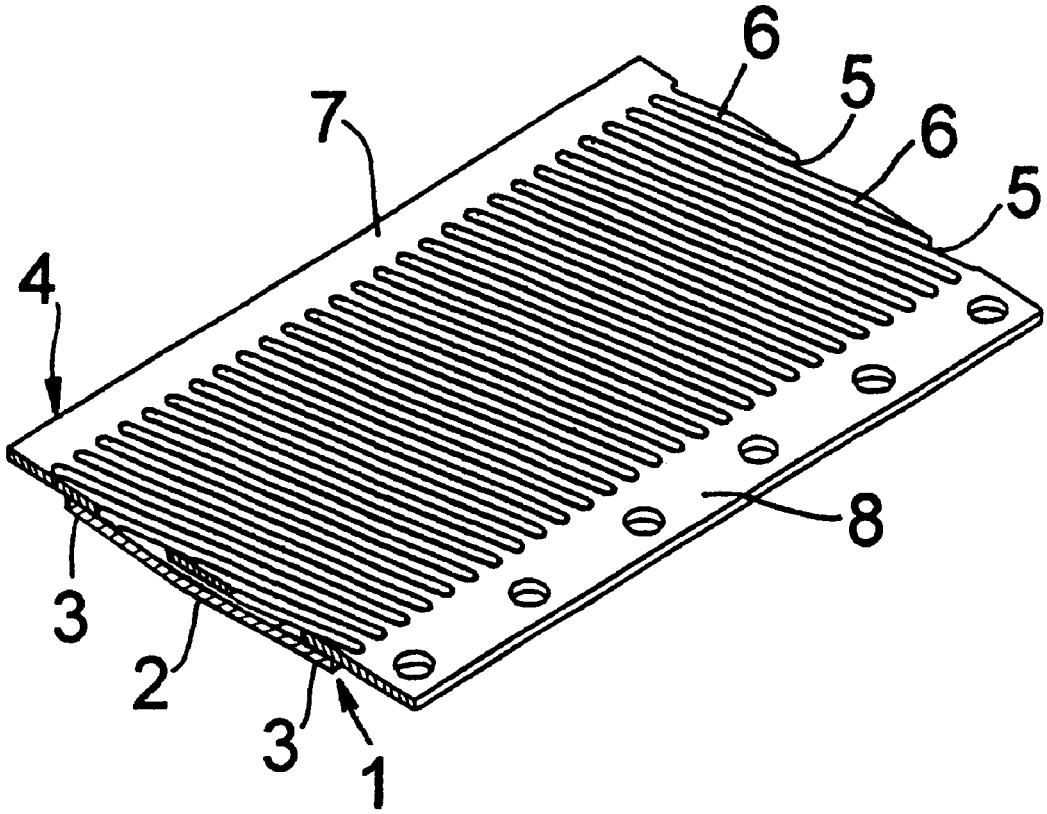
Figure 6:
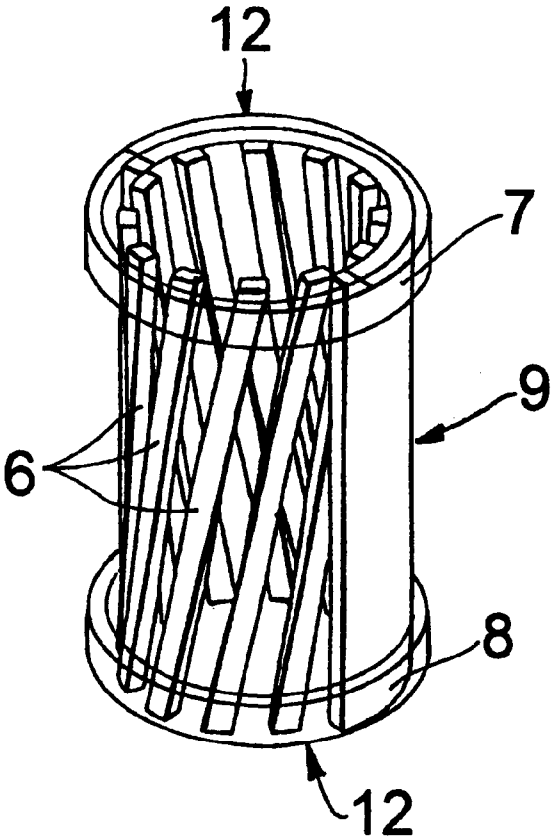
Figure 4:
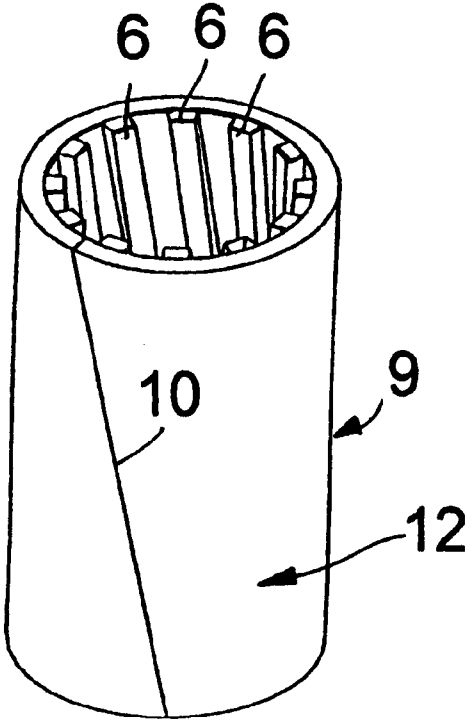
Figure 3:
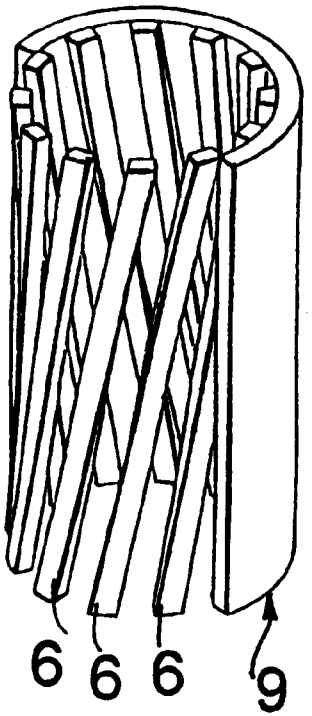
Figure 5:
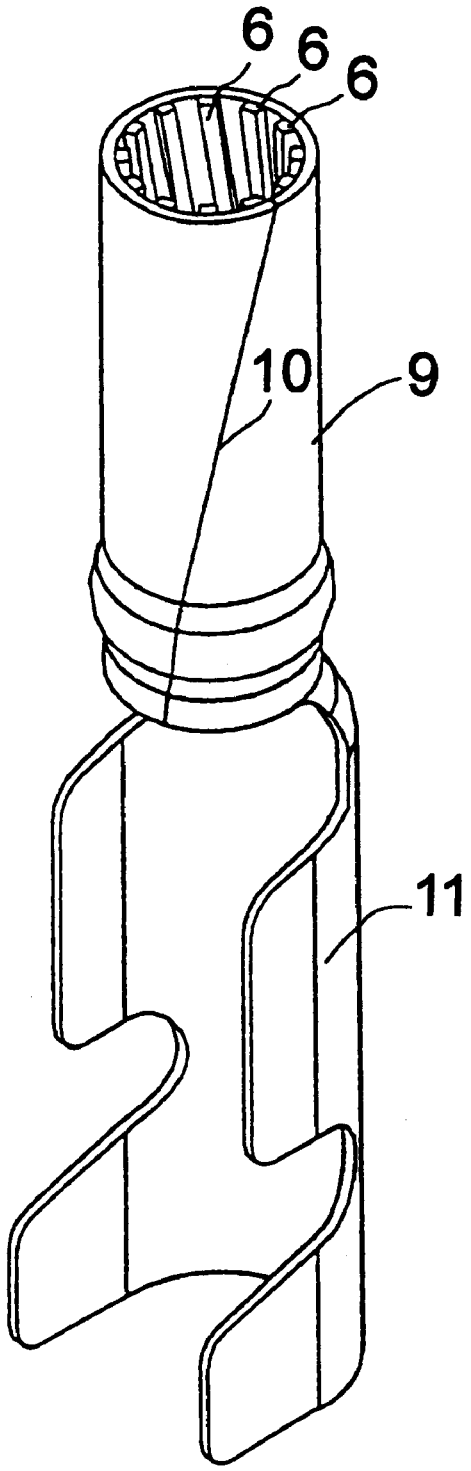

The invention is described in detail in the following examples of two embodiments, shown in the drawing, in which FIG. 1 shows a diagrammatic representation of a longitudinal section of a continuous strip of a sheet metal material, provided with a curvature, directed transversely to its plane, as well as with strip-shaped contacting means, formed by punching out these means from strip-shaped contacting means, FIG. 2 shows a front view of FIG. 1, FIG. 3 shows a partially broken open diagrammatic representation of a longitudinal section of the sheet metal material, equipped with strip shaped contacting means and rolled up into a cylindrical contacting jack, FIG. 4 shows a closed diagrammatic representation of a longitudinal section of the sheet metal material, equipped with strip-shaped contacting means and rolled up into a cylindrical contacting jack, FIG. 5 shows a closed diagrammatic representation of a contact jack provided with a connecting part and FIG. 6 shows a diagrammatic representation of a modified embodiment of a longitudinal section of the sheet metal material, equipped with strip shaped contacting means and rolled up into a cylindrical contact jack.

In the course of producing an embodiment of a contact jack for electrical plug-in connectors, shown in FIGS. 1 to S, an originally smooth strip 1 of a strip material of an electrically conducting sheet metal material is provided with a central curvature 2, directed transversely to its longitudinal extent and downwards in the plane of the drawing in such a manner, that a longitudinal edge regions 3 with a smooth surface is retained along each of the two longitudinal edges. At the same time, a plurality of stampings 5 are punched out from a wider, second strip 4 of a thinner strip material of an electrically conducting sheet metal material in such a manner that, in the embodiment shown, wire-shaped contacting means 6 are retained between the punched-out stampings 5, have a rectangular cross-sectional shape and, moreover, remain connected at both sides each with an edge strip 7 or 8, the contacting means 6 at the same time being connected with one another over the edge strips 7 or 8, the spacing between them also being assured. As is evident particularly from the representations of FIGS. 1 and 2, the contacting means 6 are punched out from a strip of material 4, having a width exceeding the width of the strip material 1, used to produce the stable sleeve body, by the width of the spacing-assuring edge strips 7 or 8, and using a contact-assuring joint-producing method, the contacting means, bridging the curvature or deformation 2 of which, are connected along the two longitudinal edge regions 3 of which individually with strip material forming the stable sleeve body, before the two edge strips 7 and 8 are severed from the wire-shaped contacting means 6 in order to achieve the final form of the construction and arrangement of the contacting means, shown in FIG. 3. From the representations of FIGS. 1 and 2, it can furthermore be seen that the stampings 5, forming the wire-shaped contacting means 6, are punched out of the strip material at an angle to the longitudinal axis of the second strip 4 of thinner strip material, corresponding to the intended alignment of the contacting means 6 with respect to the axis of the jack.

From the composite of wire-shaped contacting means 6 and a strip material 1, forming a stable sleeve body 9, produced in this way and forming a semi-finished product, longitudinal sections are severed, which correspond in their length to the sheath surface 12 of an intended cylindrical sleeve body 9 and subsequently, with stretching of the curvature 2 of the strip material 1, rolled up, for example, into a cylindrical jack shown in FIG. 4. The longitudinal sections are cut to length from the composite material, forming a semi-finished product, along the lines in 10 extending at an angle to the longitudinal axis of the strip material 1. In accordance with the representation of FIG. 5, the inventive jack can also be produced in one part with a crimp connection 10, the crimp connection 11 being cut out from a broadening of the strip of supporting material 1, the details of which are not shown in the drawing.

In contrast to the embodiments, shown in FIGS. 1 to 5, the embodiment, shown in FIG. 6, is distinguished owing to the fact that the wire-shaped contacting means 6, punched out in the wider, second strip 4 of a thinner strip material from an electrically conducting sheet metal material by means of a plurality of stampings 5, have been connected with the strip material forming the stable sleeve body by flanging 12 the spacing-assuring edge strips 7 and 8 about the longitudinal edges of this strip material, the flanges 12 being formed in the region of the strip material lying between the two space-assuring edge strips 7 and 8.

What is claimed is:

1. A method for producing contact jacks for electric plug-in connectors, which comprise at least a stable sleeve body and a plurality of contacting means including contacting strips to engage in one of a linear and a strip-shaped contact and for which the contacting strips are aligned twisted around an axis of a jack, the stable sleeve body consisting of a sheet metal material and the contacting means being connected at both ends with the sheet metal material, comprising the steps of:

a) providing a continuous strip of a sheet metal material, as a supporting material, with one of a curvature that is limited on both sides by flat longitudinal edge regions and a comparable deformation that is directed longitudinally centrally and transversely to its plane;

b) punching out a contact strip sequence for producing contacting means formed as contacting strips in strip material having a width exceeding a width of the supporting material used for producing the stable sleeve body, while leaving spacing-assuring edge strips;

c) undetachably connecting the contacting strips along respective longitudinal edge regions with the supporting material by using a contact-assuring method of joining and bridging the one of the curvature and comparable deformation;

d) cutting off a sheath surface of a jack from a continuous strip of a sheet metal material, equipped with the contacting means, at a length corresponding to that of a jack, and rolling the surface into a jack; and e) during the rolling up step, bringing one of the curvature and comparable deformation into a stretching position such that the finished jack has a smooth cylindrical outer surface.

2. The method of claim 1, further comprising the step of separating the spacing-assuring edge strips.

3. The method of claim 1, wherein the step of undetachably connecting further includes the step of contacting strips to the two longitudinal edge regions of the supporting material by one of a welding and a soldiering and a pressing method.

4. The method of claim 1, wherein the step of punching out further includes the step of punching out the contacting strips from the strip material at an angel to the longitudinal axis of the jack corresponding to an intended alignment with respect to the axis of the jack.

5. The method of claim 1, wherein the step of connecting further includes the step of connecting the contacting strips with the supporting material by flanging the spacing-assuring edge strips about the longitudinal edges of the supporting material.

6. The method of claim 5, wherein the flanging is in an area between the spacing-assuring edge strips of the strip material having the punched-out contacting strips.

* * * * *